US005379623A

United States Patent [19]

Drewalowski

[11] Patent Number: 5,379,623

[45] Date of Patent: Jan. 10, 1995

[54] RADIAL MILLING HEAD

[75] Inventor: Horst Drewalowski, Schwarzenbek, Germany

[73] Assignee: Wilhelm Fette GmbH, Schwarzenbek, Germany

[21] Appl. No.: 143,468

[22] Filed: Oct. 26, 1993

[51] Int. Cl.[6] ..... B21H 3/04

[52] U.S. Cl. ..... 72/104; 72/121

[58] Field of Search ..... 72/104, 108, 118, 121, 72/123; 470/73, 79

[56] References Cited

U.S. PATENT DOCUMENTS 3,352,139 11/1967 Cummings ..... 72/123
3,913,365 10/1975 Kruse ..... 72/104

FOREIGN PATENT DOCUMENTS

2335651C2 11/1980 Germany .
2441387C2 3/1987 Germany .

*Primary Examiner*—Lowell A. Larson
*Attorney, Agent, or Firm*—Vidas, Arrett & Steinkraus

[57] ABSTRACT

The present invention relates to a radial milling head, in particular for thread milling, comprising a casing, a plurality of peripherally spaced rollers which are equidistantly arranged about a center axis of said casing and which are rotatably supported in said casing, a gear wheel each secured to a respective roller, a central gear wheel mashing with said roller gear wheels, said rollers including a peripheral working surface, having a diameter spirally increasing for working the workpiece, a locking means including a spring biased locking member and a release means for releasing said locking member to initianally rotate said rollers into frictional engagement with the workpiece by a rotational movement of said spring biased locking member, whereupon said rollers are further rotated by frictional engagement with said workpiece until the locking member and said rollers are locked again after having performed a full rotation. According to the invention a trip member is provided which is slidably arranged concentrically with respect to said center axis of said casing, said trip member cooperating through a linkage mechanism with said release member to initiate a full rotation of said rollers, when said trip member is axially displaced by a workpiece entering between said rollers. The present invention provides for an automatical release of the working cycle, when a workpiece enters the milling head, as the release mechanism is actuated by the workpiece through a linkage mechanism.

11 Claims, 1 Drawing Sheet

RADIAL MILLING HEAD

BACKGROUND OF THE INVENTION

The present invention relates to a radial milling head, in particular for thread milling.

As to the prior art, it is referred to German patent 23 35 651 and in particular to German patent 24 41 387 disclosing an advanced embodiment of a radial milling head disclosed in the German patent first referred to. A radial milling head comprises three rollers which are rotatably supported in a casing. Each roller is secured to a gear wheel, all three gear wheels meshing with a central gear wheel wich is rotatably supported in the casing. The equidistantly and peripherally spaced arrangement of the three rollers with respect to a central axis of the casing provides a gap for axially entering a workpiece which outer periphery is to be worked, for example to receive a threaded portion.

There is a locking and releasing mechanism which allows the rollers to perform a full rotation during each working cycle. The locking and releasing is controlled by a spring biased locking member which is secured to the central gear wheel. In the rest position of the rollers, in which flats provided on the peripheral surface of each roller are facing the central axis to make it possible that a tool enters between the rollers, the locking member is in a locking position in which the central gear wheel is fixed and cannot rotate. Upon releasing the locking member, the spring acting on the locking member rotates it together with the central gear wheel, thus rotating the rollers until they come into frictional engagement with the rotating workpiece. As soon as the frictional engagement is completed, the rollers are rotatably driven by the workpiece. The peripheral working surface of the rollers has an increasing diameter so that during this movement of rotation the workpiece is worked by the peripheral surface of the rollers to mill a thread, for example. Upon completion of a full-turn of the locking member and the central gear wheel, the locking member is again stopped by a locking pin. The working cycle has been completed.

SUMMARY OF THE INVENTION

According to the prior art, the locking member is actuated by a release lever which sidewardly projects from the casing to be actuated by hand or by some other means to initiate a working cycle. For example, the release member can be actuated by an actuating red, a servocylinder or some other means which are more or less complex.

It is an object of the present invention to provide a radial milling head for automatically releasing a working cycle.

Another object of the invention is to provide a radial milling head that is durable and is less expensive.

According to the invention, the trip member which is located on the center axis of the casing is actuated by the workpiece entering the gap between the rollers. The displacement of the trip member is transferred through a linkage mechanism to the release member acting on the locking member. Accordingly, the working cycle is initiated by the work piece and not by any additional actuating elements. The present invention is particularly useful in combination with the radial milling head as disclosed in German patent 24 41 387 above referred to. The present invention particularly relates to a supplemental accessory which can be easily incorporated into the casing of the radial milling head as disclosed in the reference. This German patent 24 41 387 is therefore incorporated in the present application by reference.

It is obvious to the artisan that for performing the working cycle either the workpiece is rotating and the casing of the radial milling head is fixed, or, respectively, the workpiece is stationary and the casing is rotated.

The foregoing and other objects, features and advantages of the present invention would become apparant in the light of the following detailed description of an exemplary embodiment thereof as illustrated in the accompanying drawing.

DESCRIPTION OF THE PREFERRED EMBODIMENTS

Figure 2:
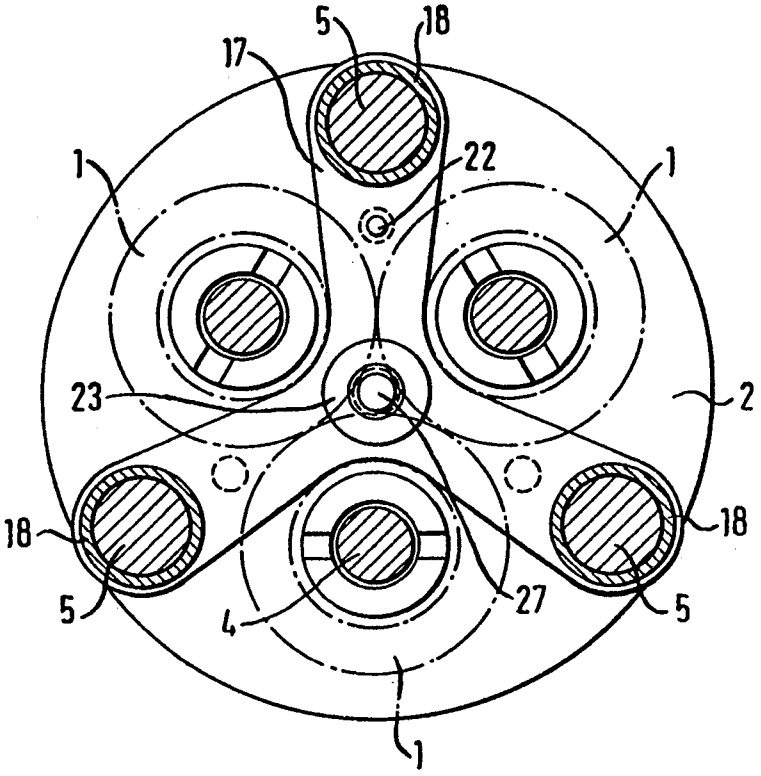
FIG. 2 is a view, partly in section taken along the line II—II in FIG. 1, in particular showing the spider plate.

The embodiment shown corresponds to the milling head illustrated and described in German patent 24 41 387 as far as the rollers, the gearing and the locking and releasing mechanism is concerned. The disclosure of this patent is thus incorporated herein for reference.

As the drawing shows, the radial milling head comprises three rollers 1 which are peripherally spaced and rotatably supported between a pair of bearing plates 2, 3. Distance rods 5 are provided between the bearing plates 2, 3.

A shaft 4 of each roller 1 is rotatably supported in the bearing plate 3, while a gear wheel 8 is connected to the opposite side of the rollers 1 which gear wheel 8 is rotatably supported in the bearing plate 2. The gear teeth of the gear wheels 8 are in meshing engagement with the toothing provided on a central gear wheel 9. Accordingly, when the central gear wheel 9 is rotated, it will rotate all rollers 1 through their gear wheels 8.

Figure 1:
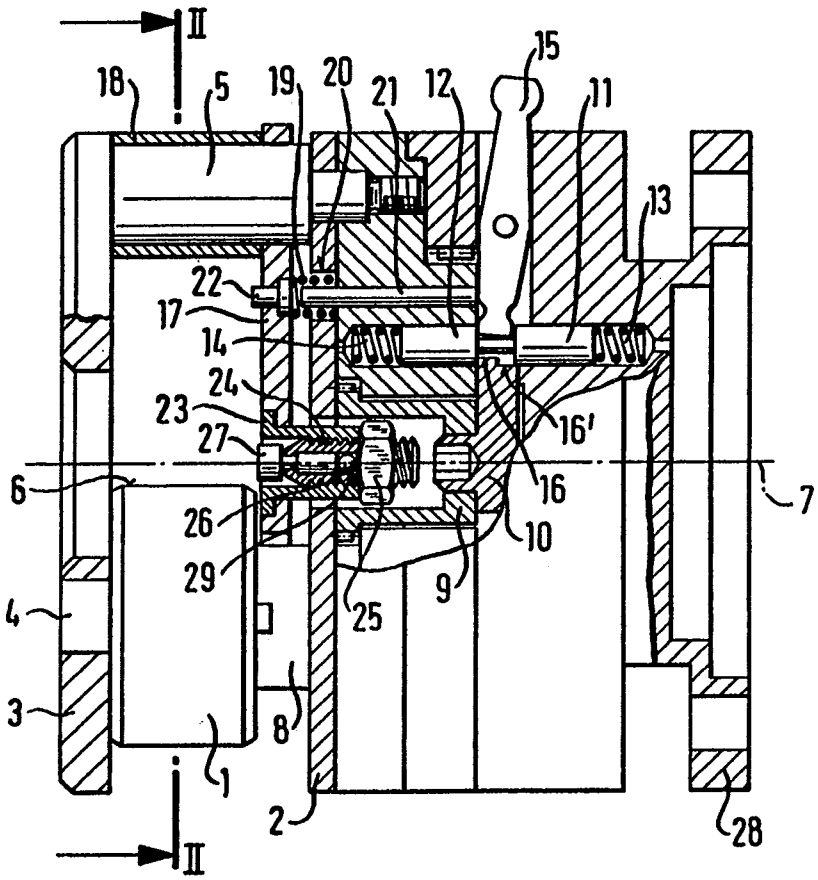
FIG. 1 is a sectional view of a radial milling head according to the invention, in particular showing the automatical release means

FIG. 1 further shows the peripheral working surface 6 of one of the rollers 1. As described and shown in the German patent 24 41 387 referred to each peripheral surface has some flat portion facing towards the central axis 7 of the casing when the rollers are in the rest position, in which a work piece (not shown) is axially moved into the gap between the rollers 1. Starting out from the flat portion on the peripheral surface 6, the diameter of the roller spirally increases over an angle of about 180°, followed by a peripheral surface which is located concentrically to the roller axis extending over an angle of about 90°. Over the remaining 90° the diameter of the peripheral surface 6 decreases ending up in the flat portion.

A locking member 10 is secured to the end face of the central gear wheel 9. The locking member 10 is defined by an arm which end cooperates with a pair of locking pins 11 and 12 which are biased by a spring 13, 14, each. A release lever 15 extends between the pair of locking pins 11 and 12. The release lever 15 is a double-armed lever rotatably supported in the casing, with its free end thereof projecting out of the casing for being actuated by hand or by some actuating means (not shown).

The locking pins 11, 12 are biased in the locking position by the springs 13 and ]4. As the spring 14 acting on the pin 12 exerts a higher bias force than the spring 13, the pin 12 in its forward position rests on a stop face 16 of the arm 10, whereas pin 11 is urged onto the side wall of the arm 10.

For releasing the arm 10, the release lever 15 is pivoted to displace the locking pin 12 to the left.

When upon actuation of the release lever 15 the arm 20 is released, it will be first rotated by a spring (not shown) thus driving the gear wheels 8 through the central gear wheel 9 into frictional engagement with the rotating workpiece. From now on, the further rotation of the rollers is caused by the rotating workpiece until a full turn of 360° is completed. While this rotation continues, the milling operation is performed and the locking member 10 rotates until the locking pin 11, 13 urged by the spring 13 to engage a stop face 16′ on the arm 10. Thereafter the pin 12 moves the pin to the right and the locked position of the arm 10 is reestablishes. Now the workpiece can be removed from the milling head. As to further details of the locking mechanism it is referred to German patent 24 41 387.

According to the invention, an automatic release mechanism is incorporated in the milling head. This mechanism comprises a spider plate 17 having three legs (FIG. 2) extending between the roller gear wheels 8 towards the rods 5. The ends of the legs are connected to sleeves 18 which are slidably supported on the rods 5. Accordingly, the spider plate 17 is axially guided for displacement. The spider plate 17 is urged towards the outer bearing plate 3 by a plurality of springs 19 acting on the legs of the spider plate which springs are supported in openings 20 of the bearing plate 2. A pin 21 is slidably guided in a bore of the casing. The pin 21 can be axially displaced by the spider pin 17. The pin 21 rests on the release lever 15 close to the end extending between the locking pins 11 and 12. For cooperating with the pin 21, the spider plate is provided with a hardened insert member 22.

A sleeve 23 having an inner threaded portion is centrally secured to the spider plate concentrical with respect to the central axis 7. A set screw 24 is screwed into the inner threaded portion of the sleeve 23. The axial position of the set screw 24 is secured by a nut 25. The set screw 24 includes a blind bore in which a trip member 27 is received which is axially supported by a ball 26 placed at the bottom of the blind bore. The trip member 27 includes an enlarged head which somewhat projects over the spider plate 17.

The automatical release mechanism operates as follows: A workpiece (not shown) entering the gap between the rollers 1 will come in engagement with the enlarged head of the trip member 27 which is rotatably supported in the set screw 24. As the trip member 27 rotates together with the rotating workpiece, there is no wear therebetween. The workpiece resting on the trip member 27 subsequently displaces the spider plate 17 thus moving the pin 21 to the right and pivoting the release member 15 into the release position. By this the working cycle is initiated. After the working cycle has been terminated, the workpiece is removed from the milling head, and the spider plate 17 is returned to its rest position by the biase spring 19. By means of the locking pins 11, 12 and the springs 13, 14 the release lever 15 is returned into its locking position.

The axial adjustment of the set screw 24 within the threaded sleeve 23 allows to finally adjust the local engagement of the rollers on the workpiece. As it is obvious, in addition to the automatical release by the linkage mechanism including the spider plate 17 and the trip member 27, it is possible to initiate a working cycle manually by actuating the release lever 15. The milling head comprises a flange 28 which can be secured to a foot block of a turning machine, for example.

What is claimed is:

1. Radial milling head, comprising a casing, a plurality of peripherally spaced rollers which are equidistantly arranged about a center axis of said casing and which are rotatably supported in said casing, a plurality of roller gear wheels each secured to a respective roller, a central gear wheel meshing with said roller gear wheels, said rollers including a peripheral working surface, having a diameter spirally increasing for working the workpiece, a locking means including a spring biased locking member and a release means for releasing said locking member to initially rotate said rollers into frictional engagement with the workpiece by a rotational movement of said spring biased locking member, whereupon said rollers are further rotated by frictional engagement with said workpiece until the locking member and said rollers are locked again after having performed a full rotation, a trip member which is slidably arranged concentrically with respect to said center axis of said casing, said trip member cooperating through a linkage mechanism with said release member to initiate a full rotation of said rollers when said trip member is axially displaced by a workpiece axially entering between said rollers.

2. The radial milling head of claim 1, wherein said trip member is biased by a spring into a workpiece engaging position.

3. The radial milling head of claim 2, wherein the trip member is rotatably supported in the bore of a set screw which is threadably and axially adjustably received in a sleeve of the linkage mechanism.

4. The radial milling head of claim 1, wherein said linkage mechanism comprises a slidably arranged pin resting upon said release member and being actuated by said trip member to displace said release member from a locking position into a release position.

5. The radial milling head of claim 4, characterized in that said release member is defined by a double-armed lever, one end thereof cooperating with a pair of locking pins to alternately release and lock said locking member and the other end projecting from said casing, said pin engaging said locking lever between said first end and a pivotal support.

6. The radial milling head of claim 5, wherein said pin is actuated by a plate which is axially displaced by said trip member when being engaged by a work piece.

7. The radial milling head of claim 6, wherein said plate is defined by a spider plate which is axially slidably arranged on rods extending between bearing plates of the casing in which the rollers are rotatably supported.

8. The radial milling head of claim 7, wherein said spider plate comprises legs extending through the gap between a pair of roller gear wheels and wherein sleeves are connected to the ends of said legs, said stationary bolts extending through said sleeves.

9. The radial milling head of claim 8, wherein springs are provided to bias said spider plate into a position in which the release member is in the locked position.

10. The radial milling head of claim 9, wherein said springs are arranged between a bearing plate for rotatably supporting said roller gear wheels and said spider plate.

11. The radial milling head of claim 1, wherein said trip member is axially rotatably supported by a ball.

* * * * *

UNITED STATES PATENT AND TRADEMARK OFFICE

CERTIFICATE OF CORRECTION

PATENT NO. : 5,379,623

DATED : January 10, 1995

INVENTOR(S) : Drewalowski

It is certified that error appears in the above—identified patent and that said Letters Patent is hereby corrected as shown below:

Column 1, line 49 delete "red", insert -- rod --.
Column 2, line 67 delete "]", insert -- 1 --.
Column 3, line 17 delete "reestablishes", insert -- reestablished --.

Signed and Sealed this

Eighteenth Day of April, 1995

Bruce Lehman

*Attest:*

BRUCE LEHMAN

*Commissioner of Patents and Trademarks*

*Attesting Officer*